US009315029B2

(12) United States Patent
Fernando et al.

(10) Patent No.: US 9,315,029 B2
(45) Date of Patent: Apr. 19, 2016

(54) PRINTHEAD CLEANING ASSEMBLY

(71) Applicants: Dilan Nirushan Fernando, Thornton, CO (US); Ronald Frederick Korsch, Longmont, CO (US)

(72) Inventors: Dilan Nirushan Fernando, Thornton, CO (US); Ronald Frederick Korsch, Longmont, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/448,896

(22) Filed: Jul. 31, 2014

(65) Prior Publication Data

US 2016/0031221 A1 Feb. 4, 2016

(51) Int. Cl.
*B41J 2/165* (2006.01)

(52) U.S. Cl.
CPC ..... *B41J 2/16538* (2013.01); *B41J 2/16547* (2013.01)

(58) Field of Classification Search
CPC ..... B41J 2/16547; B41J 2/16538; B41J 2002/1742; B41J 2/16523; B41J 2/16552; B41J 29/17
USPC ..... 347/22, 33, 36, 101, 104
See application file for complete search history.

(56) References Cited

U.S. PATENT DOCUMENTS

| | | | | |
|---|---|---|---|---|
| 5,103,244 | A | 4/1992 | Gast et al. | |
| 5,115,250 | A | 5/1992 | Harmon et al. | |
| 5,914,734 | A | 6/1999 | Rotering et al. | |
| 6,375,302 | B1 | 4/2002 | Medin | |
| 6,964,468 | B2 | 11/2005 | Kitahara et al. | |
| 7,524,050 | B2 * | 4/2009 | Baker et al. | 347/104 |
| 7,901,030 | B2 * | 3/2011 | Miyata et al. | 347/22 |
| 8,550,585 | B2 * | 10/2013 | Tsuchiya | 347/9 |
| 2008/0278538 | A1 | 11/2008 | Tokuno | |
| 2008/0316252 | A1 | 12/2008 | Na et al. | |
| 2012/0194603 | A1 | 8/2012 | Takeda et al. | |
| 2013/0208048 | A1 | 8/2013 | Kritchman et al. | |

FOREIGN PATENT DOCUMENTS

| | | | |
|---|---|---|---|
| EP | 2060395 | B1 | 6/2010 |
| JP | 06023999 | A | 5/1987 |
| JP | 2002079681 | A | 3/2002 |
| JP | 2007163751 | A | 6/2007 |

* cited by examiner

*Primary Examiner* — An Do
(74) *Attorney, Agent, or Firm* — Duft Bornsen & Fettig LLP

(57) ABSTRACT

System and methods for cleaning printheads and printhead wipers. One embodiment is an apparatus that includes a belt configured to rotate in a loop, and a wiper attached to the belt configured to wipe ink from a printhead. The apparatus also includes a tank configured as a reservoir for a cleaning solution, and a controller configured to drive the belt so that an end of the wiper drags across the printhead when in an upper portion of the loop and submerges in the cleaning solution of the tank when in a lower portion of the loop.

18 Claims, 4 Drawing Sheets

PRINTHEAD CLEANING ASSEMBLY

FIELD OF THE INVENTION

The invention relates to the field of printing, and in particular, to printing systems.

BACKGROUND

Inkjet printers are used for a variety of purposes, from desktop to production printing. For example, an inkjet production printer is a high-speed printer used for volume printing (e.g., one hundred pages per minute or more), and may include continuous-forms printers that print on a web of print media stored on a large roll. While a continuous-forms inkjet printer operates, the web is quickly passed underneath the nozzles of printheads of the printer, which discharge ink onto the web at intervals to form pixels.

Although most of the ink dispensed by the printheads is transferred to the web, some amount of ink remains on the nozzles of the printheads, and this amount may vary depending on the viscosity of the ink used. In order to clean the printhead nozzles and ensure that congealed ink does not interfere with the printing process, print operators sometimes use wipers to scrape off residual ink before the ink congeals. However, residual ink accumulates on the wipers as they clean the printheads and as a result the quality and effectiveness of subsequent cleanings deteriorates over time.

SUMMARY

Embodiments described herein provide a printhead cleaning assembly. Wipers run across the surface of a printhead to collect any residual ink leftover on the printhead after printing operation. The wipers are affixed around a rotating belt so that when the belt motions in a loop, the wipers at the top of the loop clean the printhead and the wipers at the bottom of the loop are cleaned in a fluid. The cleaning assembly thus ensures that the wipers (and therefore the printhead cleaned by the wipers) remain clean even after long periods of use, with little or no manual maintenance needed to clean the wipers.

One embodiment is a cleaning unit for a printhead of a printer that includes a belt configured to rotate in a loop, and a wiper attached to the belt configured to wipe ink from the printhead. The cleaning unit also includes a tank configured as a reservoir for a cleaning solution, and a drive unit configured to drive the belt so that an end of the wiper is able to drag across the printhead when in an upper portion of the loop and able to submerge in the cleaning solution of the tank when in a lower portion of the loop.

Another embodiment is a printhead cleaning system comprising a print engine operable to mark a web medium, the print engine including a printhead. The printhead cleaning system also includes a wiper attached to an outer perimeter of a belt, and a positioning system configured to position the belt underneath a printhead so that the wiper contacts the printhead. The printhea cleaning system also includes a drive system is configured to rotate the belt a first distance to cause the wiper to remove ink from the printhead, and to rotate the belt a second distance to cause the wiper to submerge in a liquid.

Yet another embodiment is a system that includes a print engine operable to mark a web medium, the print engine including a printhead. The system also includes a plurality of wipers attached around an outer perimeter of a belt that is configured to move the plurality of wipers in a revolving motion. The system also includes a tank configured as a reservoir for a cleaning solution. When the belt rotates, a first wiper drags across a printhead while a second wiper passes through the cleaning solution.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
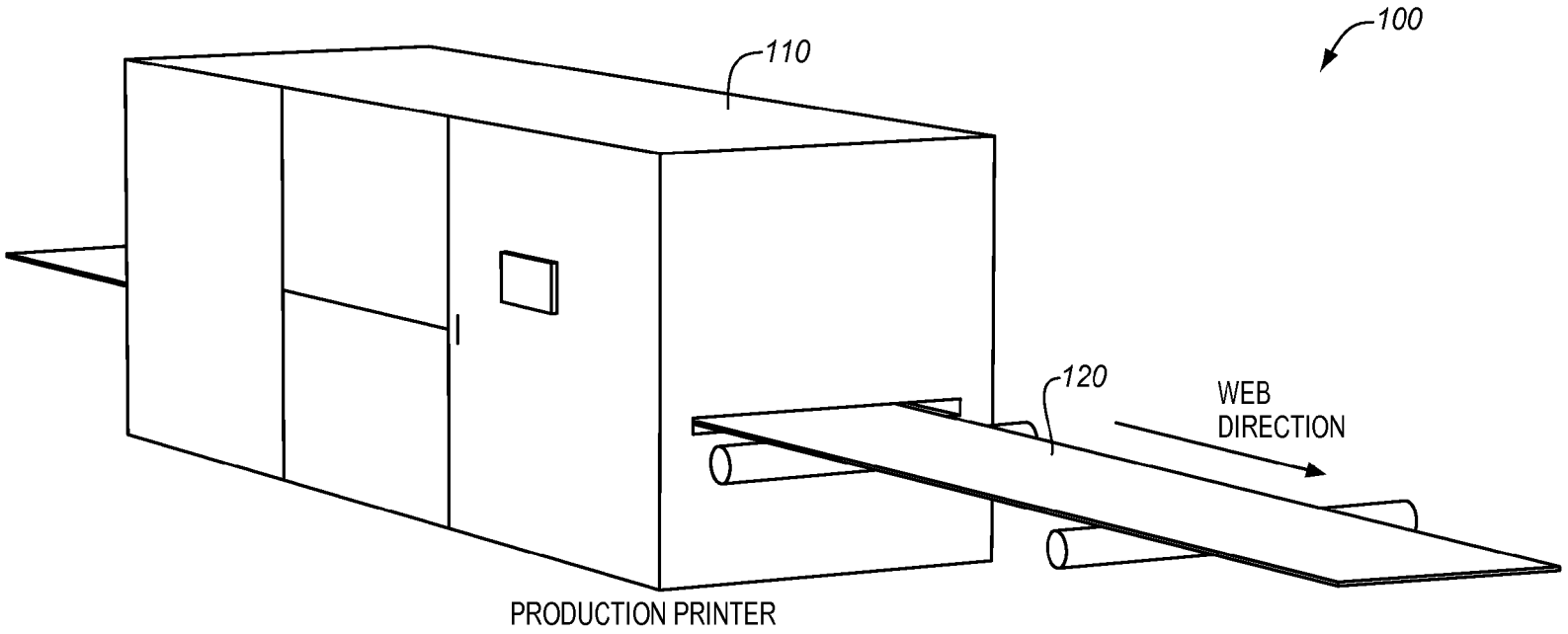
FIG. 1 is a block diagram of a printing system in an exemplary embodiment.

FIG. 1 is a block diagram of a printing system 100 in an exemplary embodiment. Printing system 100 comprises any system, device, or component operable to mark print media (e.g., paper) by applying ink (e.g., pigment inks or dye inks) onto the media. In this embodiment, printing system 100 comprises a continuous-forms printer 110 that marks a web of print media 120.

Figure 2:
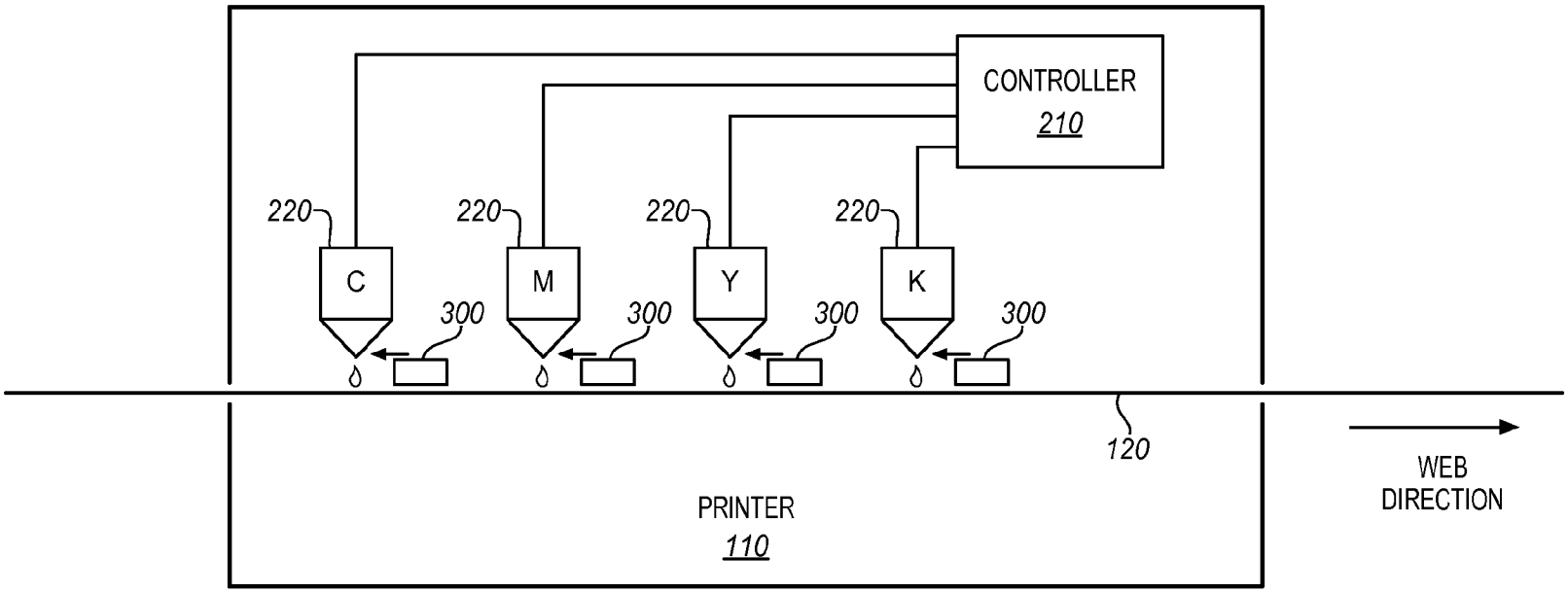
FIG. 2 is a block diagram illustrating an inside view of a printer in an exemplary embodiment.

FIG. 2 is a block diagram illustrating an inside view of printer 110 in an exemplary embodiment. FIG. 2 illustrates, in simplified form, that printer 110 includes multiple printheads 220. For example, printer 110 may include a print engine operable to mark the web of print media 120 with one or more printhead assemblies, with each assembly including a printhead controller 210 and a printhead 220 (or array of printheads 220). As shown in FIG. 2, each printhead 220 is used to dispense a color of ink (e.g., Cyan, Magenta, Yellow, or Key black) onto print media 120. However, in alternate embodiments, each printhead 220 includes nozzles for each of multiple different colors of ink.

The operations of printheads 220 are directed by print controller 210. For example, print controller 210 may instruct printheads 220 to mark specific pixel locations on media 120 during printing. In between print operations, print controller 210 may initiate cleaning operations of the printheads 220 through operation of one or more printhead cleaning assemblies 300. Printer controller 210 may be implemented, for example, as custom circuitry, as a processor executing programmed instructions stored in an associated program memory, or some combination thereof.

Figure 3:
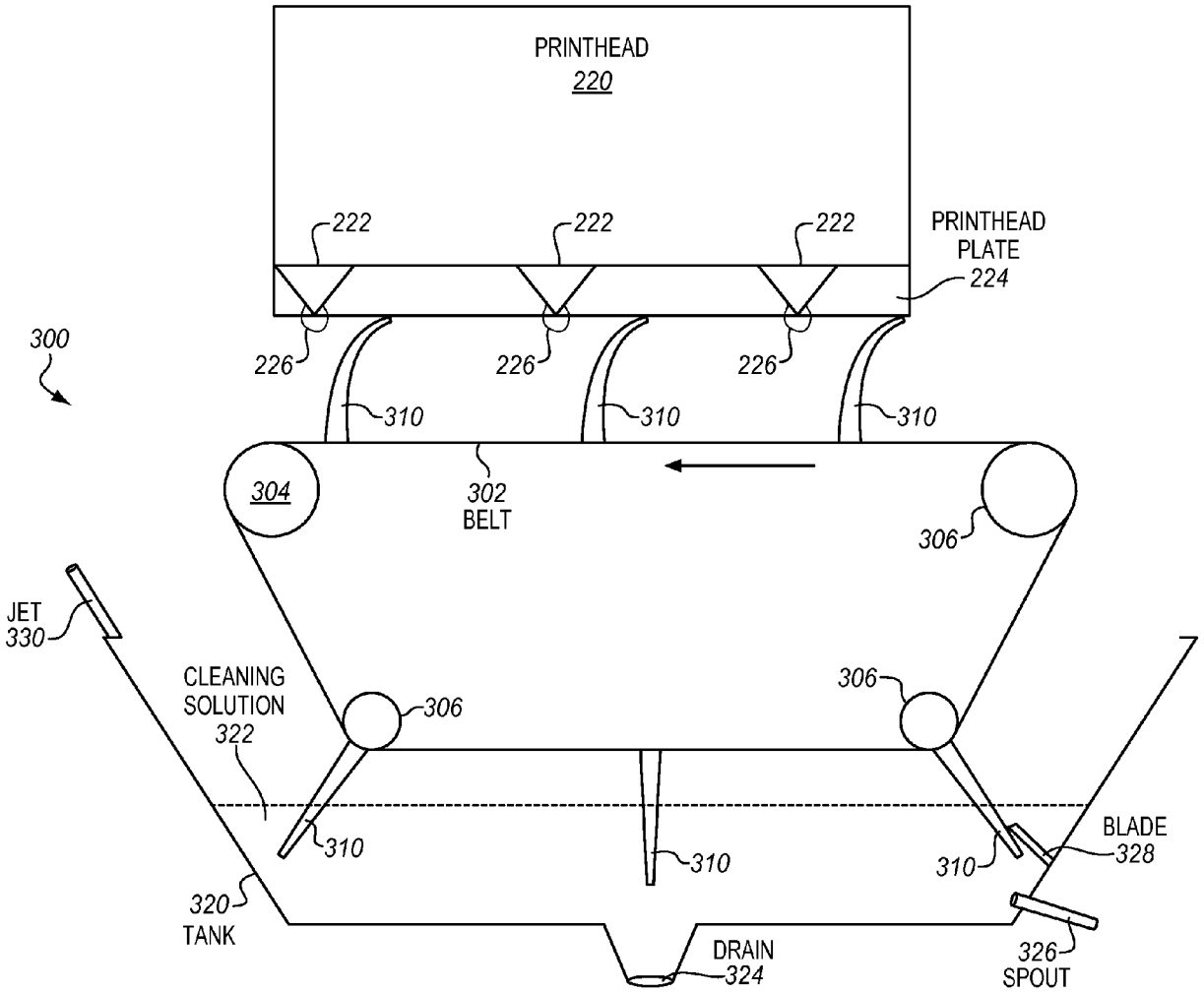
FIG. 3 is a block diagram of a printhead cleaning assembly in an exemplary embodiment.

FIG. 3 is a block diagram illustrating a printhead cleaning assembly 300 in an exemplary embodiment. Printhead cleaning assembly 300 includes a belt 302 that rotates under the power of one or more drive roller(s) 304 and may be additionally supported by one or more idle rollers 306. Printhead cleaning assembly 300 further includes one or more wipers 310 attached to belt 302 which move with belt 302 in the direction shown. Wipers 310 may be comprised of an elastic material (e.g., rubber, an elastic polymer, etc.) that are driven across printhead plate 224 of printhead 220 in order to remove residual droplets of ink 226 from each printhead nozzle 222. In prior systems, the wiping action may leave a residual amount of ink on a wiper which may dry and degrade the ability of that wiper to clean printheads.

Printhead cleaning assembly 300 is therefore further enhanced with a tank 320 configured to retain a cleaning solution 322 that washes and/or lubricates wipers 310 as wipers 310 rotate. Print controller 210 operates a drain 324 in tank 320 to open/close for draining/collecting cleaning solution 322. Print controller 210 also operates a spout 326 to replenish tank 320 with cleaning solution 322. Print controller 210 may receive input from sensors, timers, users, etc. that help inform appropriate drainage/collection of cleaning solution 322 in tank 320.

Advantageously, the same rotating action of belt 302 that wipes printhead plate 224 with wipers 310 also cleans (e.g., submerges, washes, scrapes, lubricates, etc.) wipers 310 on the other side of belt 302. Moreover, printhead cleaning assembly 300 provides a relative short period of time between when ink is collected on a wiper and when that wiper is submerged in cleaning solution 322 to eliminate or at least reduce the chance that ink is able to accumulate on wipers 310. The self-cleaning wiper mechanism described herein reduces manual maintenance for the printheads and the wipers that clean the printheads.

In one embodiment, the tank 320 also includes a blade 328 that scrapes wipers 310 when wipers 310 rotate past blade 328 to remove congealed/residual ink from wiper 310. Blade 328 may be positioned in tank 320 at a far end from where wipers 310 are initially submerged (as shown in FIG. 3) in cleaning solution 322 to give sufficient time for any dried ink on wipers 310 to loosen/dissolve in cleaning solution 322 before being scraped by blade 328. Furthermore, blade 328 may be submerged in cleaning solution 322 so that after the surface of wiper 310 is scraped by blade 328 it is lubricated by cleaning solution 322 prior to engaging or re-engaging with printhead plate 224. However, alternative embodiments are possible, including a tank with a blade attached in a different location, a non-submerged blade, multiple blades, no blade, etc.

Print controller 210 may initiate printhead cleaning at regular intervals or in response to an event (e.g., after a certain number of pages, at the end of each job, after a specific time interval, after a cleaning or flushing cycle of a printhead 220, etc.). If viscous inks are used by printheads 220, a cleaning operation may be initiated more often to ensure that printhead nozzles 222 do not clog. Alternatively or additionally, a print operator may initiate a printhead cleaning operation via a graphical user interface of printer 110.

During printing operation of printer 110, printhead cleaning assembly 300 may be positioned in a home storage location (e.g., elsewhere in printer 110) so as not to obstruct printing operation of printheads 220. When print controller 210 determines to initiate printhead cleaning, a positioning system (not shown) is operable to position printhead cleaning assembly 300 underneath the targeted printhead(s) 220 to be cleaned. When cleaning operations are complete, print controller 210 may direct the positioning system to return printhead cleaning assembly 300 to the home storage location.

Print controller 210 may also manage maintenance of printhead cleaning assembly 300. For example, print controller 210 may receive input, either manually (e.g., command sent from a print operator) or automatically (e.g., fluid sensors, timers, print events, number of printhead cleaning operations, etc.), that a sufficient level of ink from printheads 220 has accumulated in cleaning solution 322. In response, print controller 210 may initiate a sequence to direct drain 324 to purge cleaning solution 322 from tank 320 so that a fresh supply of cleaning solution 322 may be replenished in tank 320 via spout 326.

In one embodiment, with drain 324 open to purge contaminated cleaning solution 322, print controller 210 directs a drive system to rotate belt 302 while spout 326 sprays cleaning solution 322 toward wipers 310 as wipers 310 move past spout 326. With spout 326 in a fixed position in tank 320, the spray of cleaning solution 322 contacts wipers 310 in a sliding vertical motion as wipers 310 move closer to spout 326 with the rotation action of belt 302, thereby removing/loosening ink residue buildup on wipers 310. Print controller 210 may, at some point during this process, close drain 324 while spraying cleaning solution 322 at wipers 310 with spout 326 in order to simultaneously recollect cleaning solution 322 in tank 320 in preparation for subsequent printhead cleaning operations.

Print controller 210 may also be configured to perform additional, more extensive printhead cleaning operations. In one embodiment, printhead cleaning assembly 300 includes a jet 330 configured to spray a mist of cleaning solution 322 toward printhead 220. Direct application of the cleaning solution 322 to printhead 222 helps dissolve, loosen, and/or remove residual ink 226 from the printhead 220, and may be performed separately or in addition to the rotating action that drags wipers 310 across printhead 220.

In one embodiment, print controller 210 directs jet 330 to spray cleaning solution 322 as printhead cleaning assembly 300 moves into position to clean printhead 220. To illustrate, when a printhead cleaning operation is to be performed on printhead(s) 220, printhead(s) 220 may be lifted vertically while a positioning system moves printhead cleaning assembly 300 (laterally and/or vertically) into a position vertically underneath printhead(s) 220. As the cleaning assembly nears a printhead 220 to be cleaned, jet 330, being attached to cleaning assembly 300 and a supply of cleaning solution 322 (either from the source of tank 320 or elsewhere in the printer 110), shoots a mist of cleaning solution 322 toward the surface of printhead plate 224 to lubricate printhead plate 224. The lateral movement of printhead cleaning assembly 300 as it positions underneath printhead 220 allows jet 330 to target cleaning solution 322 at printhead 220 for the length of printhead 220 and collect any debris/fluid that falls from printhead 220 in tank 320. This operation may be performed in addition and/or prior to the wiping of printhead 220 with wipers 310.

Printhead cleaning assembly 300 advantageously maintains wipers 310 while performing other cleaning operation routines. For instance, wipers 310 may be rotated into cleaning solution 322 while printhead cleaning assembly 300 remains engaged with printhead 220, while printhead cleaning assembly 300 positions to a subsequent printhead, while printhead cleaning assembly 300 positions to a storage location away from printheads 220 so that printing operation may resume, or while printhead cleaning assembly 300 cleans the subsequent printhead. The number of wipers 310 attached to belt 302 may vary by matter of design choice, but may be selected such that printhead cleanliness is maximized while printhead wear is minimized. In one embodiment, print controller 210 is configured to direct a belt drive system to rotate belt 302 a distance that substantially matches the length of printhead 220 and then pause so that wear is minimized.

It will be appreciated that belt 302 may be configured in shapes other than that shown in FIG. 3 that allow a wiper 310 affixed to belt 302 to cycle around with continued rotation of belt 302. In one embodiment, belt 302 is configured in a loop such that a top portion of the loop is parallel with the surface of printhead 220 and a bottom portion of the loop submerges at least the tips of wipers 310 in cleaning solution 322 collected in tank 320. However, wipers 310 and/or belt 302 may completely submerge in cleaning solution 322 at portions of the loop as a matter of design choice.

Furthermore, belt 302 and wipers 310 may rotate, and printhead cleaning assembly 300 may be positioned, using any suitable drive systems (e.g., motors, tracks, etc. in addition to or as part of any suitable combination of drive rollers 304, idle rollers 306, belt drive system, positioning system, etc.). Moreover, wipers 310 and belt 302 may rotate in the opposing direction (e.g., to additionally clean printhead 220 and/or wipers 310). In one embodiment, belt 302 includes at least two wipers 310 disposed on relatively opposite sides of the loop of belt 302 such that cleaning of printhead 220 and cleaning of at least one wiper 310 is performed in a simultaneous fashion.

Figure 4:
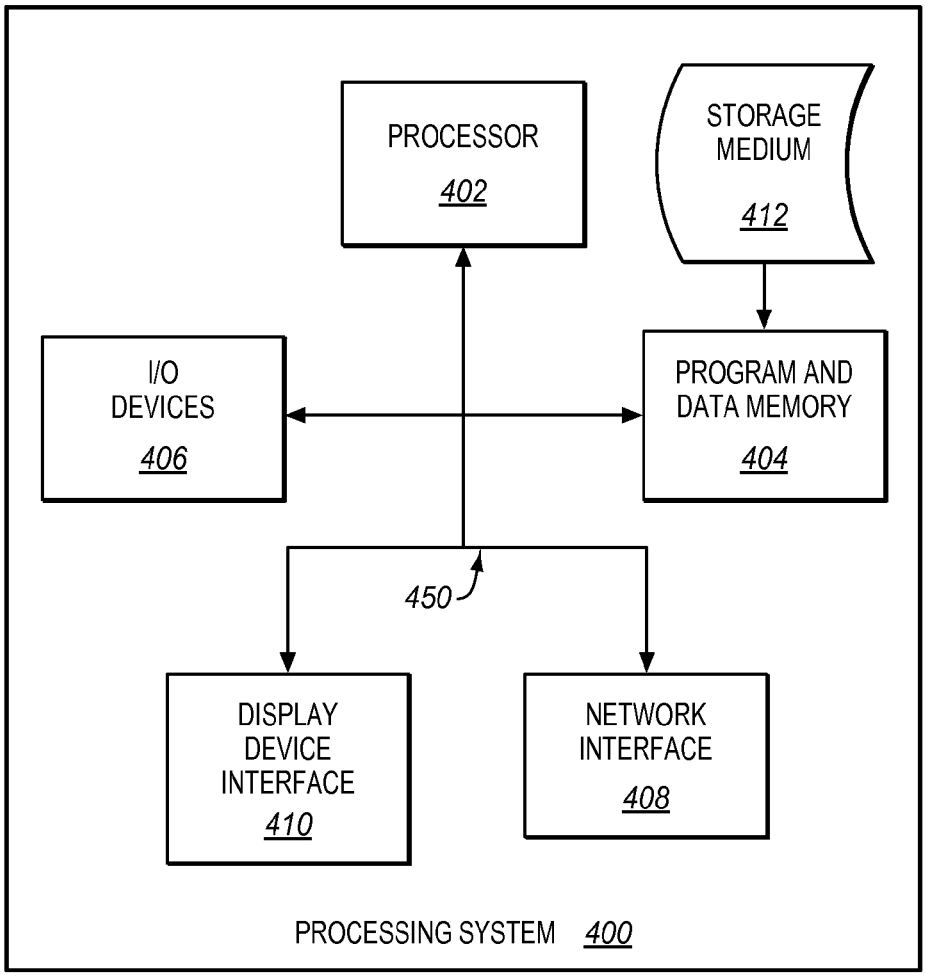
FIG. 4 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of the print server 120 to perform the various operations disclosed herein. FIG. 4 illustrates a processing system 400 configured to execute a computer readable medium embodying programmed instructions to perform desired functions in an exemplary embodiment. Processing system 400 is configured to perform the above operations by executing programmed instructions tangibly embodied on computer readable storage medium 412. In this regard, embodiments of the invention can take the form of a computer program accessible via computer-readable medium 412 providing program code for use by a computer or any other instruction execution system. For the purposes of this description, computer readable storage medium 412 can be anything that can contain or store the program for use by the computer.

Computer readable storage medium 412 can be an electronic, magnetic, optical, electromagnetic, infrared, or semiconductor device. Examples of computer readable storage medium 412 include a solid state memory, a magnetic tape, a removable computer diskette, a random access memory (RAM), a read-only memory (ROM), a rigid magnetic disk, and an optical disk. Current examples of optical disks include compact disk—read only memory (CD-ROM), compact disk—read/write (CD-R/W), and DVD.

Processing system 400, being suitable for storing and/or executing the program code, includes at least one processor 402 coupled to program and data memory 404 through a system bus 450. Program and data memory 404 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 406 (including but not limited to keyboards, displays, pointing devices, etc.) can be coupled either directly or through intervening I/O controllers. Network adapter interfaces 408 may also be integrated with the system to enable processing system 400 to become coupled to other data processing systems or storage devices through intervening private or public networks. Modems, cable modems, SCSI, Fibre Channel, and Ethernet cards are just a few of the currently available types of network or host interface adapters. Presentation device interface 410 may be integrated with the system to interface to one or more presentation devices, such as printing systems and displays for presentation of presentation data generated by processor 402.

Although specific embodiments were described herein, the scope of the inventive concept(s) is not limited to those specific embodiments. The scope of the inventive concept(s) is defined by the following claims and any equivalents thereof.

We claim:

1. A cleaning unit for a printhead of a printer, the cleaning unit comprising:

a belt configured to rotate in a loop;

a wiper attached to the belt configured to wipe ink from the printhead;

a tank configured as a reservoir for a cleaning solution; and a drive unit configured to drive the belt so that an end of the wiper is able to drag across a surface of the printhead when in an upper portion of the loop and able to submerge in the cleaning solution of the tank when in a lower portion of the loop.

2. The cleaning unit of claim 1 wherein:

the upper portion of the loop is parallel with the surface of the printhead.

3. The cleaning unit of claim 1 further comprising:

a blade extending from a bottom of the tank and submerged in the cleaning solution, the blade configured to scrape the wiper when the wiper rotates past the blade.

4. The cleaning unit of claim 1 further comprising:

a drain in the tank configured to purge the cleaning solution.

5. The cleaning unit of claim 4 further comprising:

a spout in the tank configured to supply the tank with the cleaning solution.

6. The cleaning unit of claim 5 wherein:

after the drain has opened to purge the cleaning solution from the tank, the drive unit is configured to rotate the belt while the spout jets the cleaning solution toward the wiper as the wiper rotates past the spout.

7. The cleaning unit of claim 1 further comprising:

a jet configured to spray the cleaning solution toward the printhead as the cleaning unit moves into position underneath the printhead.

8. A printhead cleaning system comprising:

a print engine operable to mark a web medium, the print engine including a printhead;

a wiper attached to an outer perimeter of a belt;

a positioning system configured to position the belt underneath the printhead so that the wiper contacts the printhead; and a drive system configured to rotate the belt a first distance to cause the wiper to remove ink from the printhead, and to rotate the belt a second distance to cause the wiper to submerge in a liquid.

9. The printhead cleaning system of claim 8 wherein:

the positioning system is configured to maintain the position of the belt relative to the printhead while the belt rotates the first distance.

10. The printhead cleaning system of claim 9 further comprising:

a controller configured to determine that another printhead is to be cleaned, and to direct the positioning system to initiate movement of the belt toward the another printhead while the drive system rotates the belt the second distance to cause the wiper to submerge in the liquid.

11. The printhead cleaning system of claim 8 further comprising:

a controller configured to determine to resume printing operation, and to direct the positioning system to initiate movement of the belt to a storage position away from printheads in order to resume printing operation of the printheads;

wherein the controller is configured to direct the drive system to rotate the belt the second distance to cause the wiper to submerge in the liquid while the belt moves to the storage position.

12. The printhead cleaning system of claim 8 further comprising:

the positioning system is configured to maintain the position of the belt relative to the printhead while the drive system rotates the belt the second distance.

13. A printhead cleaning system of claim 8 further comprising:

a container configured to collect the liquid, the container being attached to a position underneath the belt.

14. A system comprising:

a print engine operable to mark a web medium, the print engine including a printhead;

a plurality of wipers attached around an outer perimeter of a belt that is configured to move the plurality of wipers in a revolving motion; and a tank configured as a reservoir for a cleaning solution;

wherein when the belt rotates, a first wiper drags across the printhead while a second wiper passes through the cleaning solution.

15. The system of claim 14 wherein:

as the belt continues to rotate, the second wiper drags across the printhead while the first wiper passes through the cleaning solution.

16. The system of claim 14 wherein:

the plurality of wipers are configured to collect ink from the printhead.

17. The system of claim 16 wherein:

the cleaning solution is configured to dissolve ink collected on the plurality of wipers.

18. The system of claim 14 further comprising:

a drive roller configured to rotate the belt; and one or more idle rollers configured to support the belt.

* * * * *